US005218900A

United States Patent [19]

Elliott

[11] Patent Number: 5,218,900

[45] Date of Patent: Jun. 15, 1993

[54] SAFETY IMPROVEMENTS FOR REFUSE COMPACTORS

[75] Inventor: James D. Elliott, Cheyenne, Wyo.

[73] Assignee: American Wyott Corporation, Cheyenne, Wyo.

[21] Appl. No.: 865,914

[22] Filed: Apr. 9, 1992

[51] Int. Cl.[5] ..... B30B 15/16

[52] U.S. Cl. ..... 100/53; 100/99; 100/229 A

[58] Field of Search ..... 100/53, 99, 229 A, 215, 100/255, 246, 252; 200/61.62, 61.76, 61.78, 61.81; 141/94

[56] References Cited

U.S. PATENT DOCUMENTS

| | | | |
|---|---|---|---|
| 206,977 | 8/1878 | Sands | 100/255 X |
| 2,636,091 | 4/1953 | Carter | 200/61.79 |
| 2,873,665 | 2/1959 | Young | 100/255 X |
| 3,353,478 | 11/1967 | Hopkins | 100/53 X |
| 3,785,278 | 1/1974 | Hopkins | 100/53 X |
| 3,827,348 | 8/1974 | Hennells | 100/53 |
| 3,855,919 | 12/1974 | Potter | 100/53 X |
| 3,869,978 | 3/1975 | Steinberg et al. | 100/53 |
| 3,945,314 | 3/1976 | Hennells | 100/53 |
| 4,512,252 | 4/1985 | Goldhammer | 100/53 |
| 4,552,061 | 11/1985 | Brutsman | 100/53 |

OTHER PUBLICATIONS

American Wyott, "EH 100 and EH 200 Compactors Specification Sheet CP-80-20;" Copyright 1989.

*Primary Examiner*—Stephen F. Gerrity
*Attorney, Agent, or Firm*—Herbert J. Hammond

[57] ABSTRACT

A refuse compactor includes a frame enclosing a compaction ram for compacting waste deposited into a container. A safety chute, having a magnet, is detachably mounted to the frame via pivots and notches. A magnet sensing switch wired into the compactor's control circuit interacts with the magnet on the safety chute to prevent operation of the refuse compactor when the safety chute is misaligned or absent. A ring bolt, collar, spring and washer are mounted within the frame. A plunger on a contact switch wired into the compactor's control circuit touches the washer. The contact switch interacts with the washer on the ring bolt to prevent operation of the refuse compactor when a predetermined amount of weight is placed on the safety chute. Deflection of the spring moves the washer toward the spring, breaking contact between the washer and plunger, opening the contact switch and immediately disabling the compactor.

15 Claims, 7 Drawing Sheets

SAFETY IMPROVEMENTS FOR REFUSE COMPACTORS

TECHNICAL FIELD

This invention relates generally to the field of refuse compactors and, more particularly to safety improvements for refuse compactors.

BACKGROUND OF THE INVENTION

For many years, businesses and schools have used refuse compactors to handle the large volume of waste produced by people eating in company cafeterias and school lunchrooms. To limit the need for additional employees to pick up waste at each table, most compactors were designed as open-door systems where each person deposits waste directly into the compactor.

Because of the large volume of waste produced on a daily basis, compactors require significant compacting force to reduce the volume of refuse. Compactors must also be easy to clean because much of t-eh waste placed in compactors is food. Compactors ar usually cleaned after each use to prevent odor and rodent problems.

In refuse compactors used mainly by adults or children supervised by adults, existing safety features may be adequate. But in environments where conventional refuse compactors are used with preschoolaged children or inadequately supervised children, the safety features provided with most conventional compactors are inadequate.

There is therefore a need for a refuse compactor that can be used in environments where young children are present. Such a compactor needs not only to be safe for children to use, but easy to clean. Some prior art compactors use guards and baffles to ensure their users' safety, but the guards are difficult and time-consuming to remove, and these compactors require cleaning several times a day.

SUMMARY OF THE INVENTION

The present invention comprises a highly practical waste disposal system that overcomes the foregoing disadvantages associated with the prior art.

In one embodiment, a waste disposal system includes a frame which houses and supports the components of the system. A first chute pivotally mounted on the frame receives waste to be compacted and discharges the waste into a container disposed in the frame. A compaction ram mounted in the frame compacts the waste received by the container. A driving mechanism connected to a power source drives the compaction ram. A control circuit connected to the driving mechanism interrupts power to the waste disposal system in response to attempted intrusion into a hazardous area of the system.

There are several advantages of the present invention over prior art refuse compactors. The refuse compactor may be safely operated in an "open" position, due to the reliable method of shutting off the compactor in the event of attempted intrusion into hazardous areas. Thus, people of all ages may use the compactor without injury.

In addition, the safety improvements are wired in series with each other, so that opening any safety switch prevents the compactor from operating. Also, the safety improvements may be customized for particular types of users, such as children or adults. Finally, the safety improvements do not interfere with the cleaning or the normal use of the compactor.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
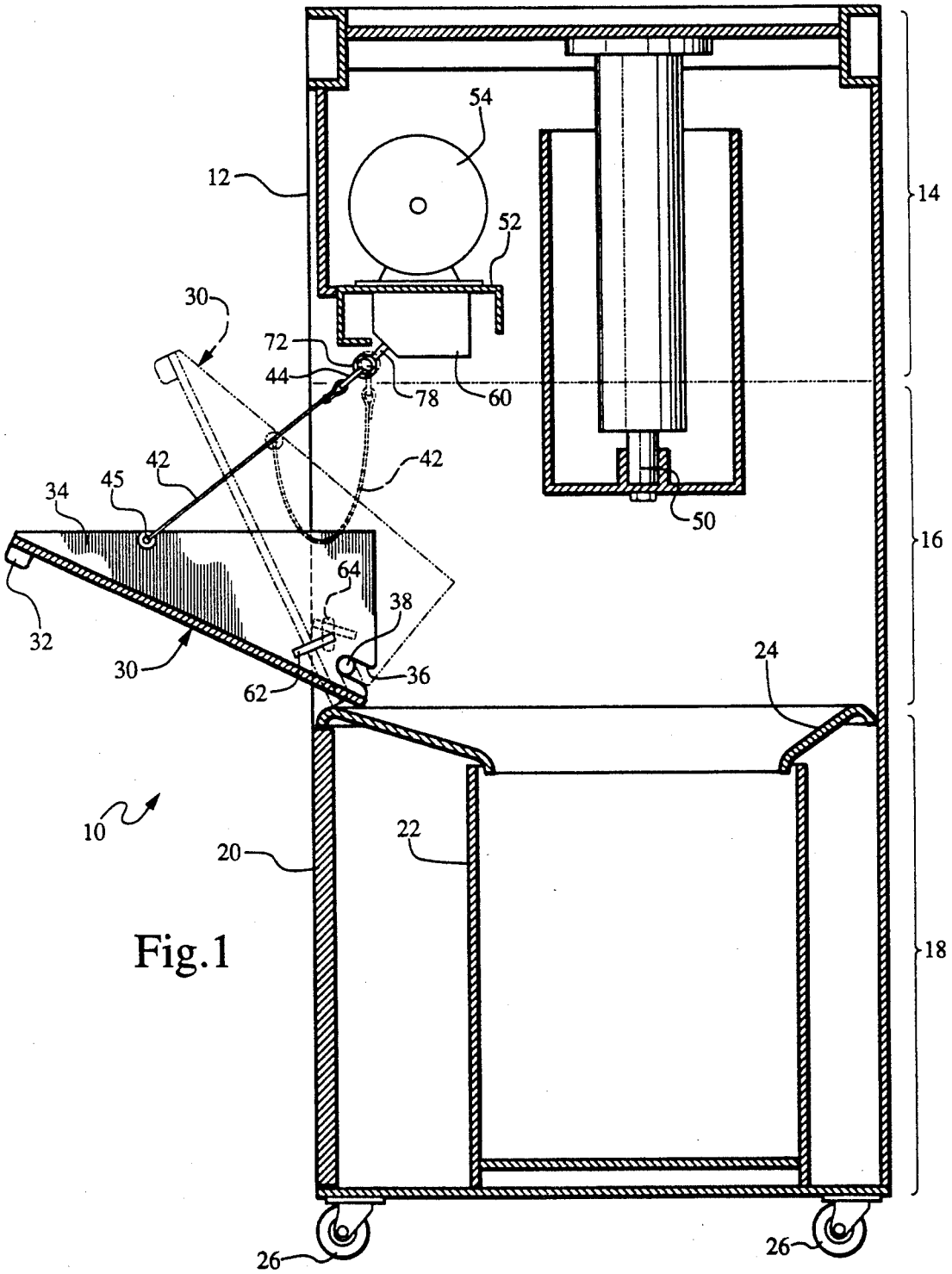
FIG. 1 is a front view of a refuse compactor according to one embodiment of the present invention.
Figure 1A:
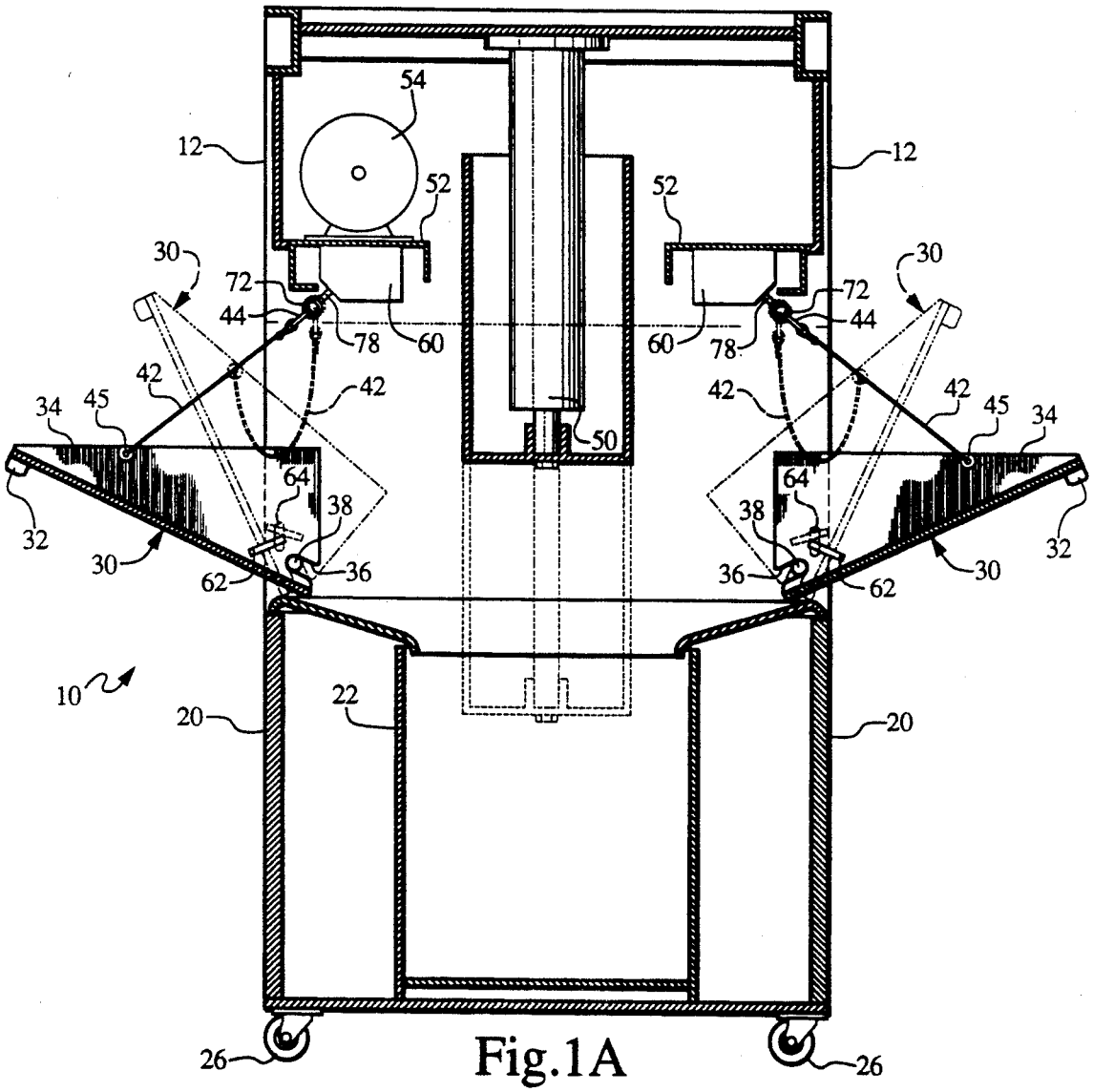
FIG. 1A is a front view of a refuse compactor of the present invention having first and second chutes.

Referring now to the Drawings wherein like reference characters designate like or similar parts throughout the seven views, FIGS. 1 and 1A are front views of a refuse compactor according to the present invention.

A refuse compactor 10 includes a frame 12 that encloses and supports the components of the compactor 10. Frame 12 is divided into three portions: an upper closed portion 14, an upper open portion 16 and a lower closed portion 18.

The upper closed portion 14 of frame 12 houses the electrical and hydraulic components of refuse compactor 10. A decorative panel (not shown) conceals these components from view. The decorative panel also serves safety and sanitary purposes, keeping users' hands and refuse away from the top of the compaction ram 50 and from the electrical and hydraulic components.

The lower end of compaction ram 50 is visible and accessible in the upper open portion 16 of frame 12 when compaction ram 50 is in a raised position. Because compaction ram 50 and other components are accessible through the opening in upper portion 16, this is a hazardous area, especially for unsupervised children. The safety features in the refuse compactor of the present invention significantly reduce the likelihood of injury to a child or other user from this area.

The lower portion 18 of frame 12 houses a container 22 for receiving and holding refuse. The lower portion 18 of frame 12 is normally concealed from view by a door 20. Door 20 may be attached to frame 12 with hinges or some other attachment device. Door 20 is secured to frame 12 along one side only so that the door may swing open as necessary.

A container 22 for receiving and holding waste is positioned at the bottom of refuse compactor 10. Container 22 may be removed for disposal of compacted refuse and for cleaning. The top of container 22 is fitted with a hopper 24 which guides refuse into container 22. Hopper 24 is easily removed from container 22 for cleaning. Rollers 26 disposed on the bottom of frame 12 allow the compactor to be moved as necessary.

A safety chute 30 containing side walls 34 is located in the upper open portion 16 of frame 12. Users deposit refuse in the safety chute, and the refuse moves into container 22 for subsequent compaction. A second safety chute (FIG. 1A) may be positioned at the rear of the compactor as desired to provide access from the opposite side of the compactor. Safety chute 30 includes a raised edge or lip 32 along the front side thereof for preventing users from reaching the compaction ram.

Safety chute 30 is located along one side of frame 12. Notches 36 in the side walls 34 of chute 30 engage pivots 38 mounted on the frame to anchor safety chute 30 to frame 12. The safety chute may be moved to a vertical position by pivots 38 and notches 36, substantially closing off the upper open portion 16 of the frame when the compactor is not in use.

Cables 42 on each side of the safety chute 30 connect the chute 30 to the frame 12. Cables 42 are placed through holes 45 in side walls 34 of safety chute 30. A snap link 44 on one end of each cable 42 attaches to an eye ring 72 secured to the subframe 60. The snap links 44 and the notches 36 in the safety chute 30 permit easy removal of the chute from the frame for cleaning.

A cylindrical collar 78 is disposed above eye ring 72. Collar 78 prevents movement of eye ring 72 into subframe 60.

A magnet 62 is mounted on safety chute 30. A magnet sensing switch 64 is mounted on frame 12 and wired into the control circuit (FIG. 6) of the compactor. When magnet 62 is sufficiently close to magnet sensing switch 64, the magnet's magnetic field magnetizes metal blades inside switch 64, closing the switch and completing the control circuit.

When safety chute 30 is improperly aligned on pivots 38, magnet 62 is not sufficiently close to magnetize the metal blades inside sensing switch 64, and switch 64 remains open. Similarly, when safety chute 30 is absent from the compactor, switch 64 remains open. The compactor cannot operate when switch 64 and the control circuit are open.

In a similar manner, container 22 and/or door 20 may be equipped with magnets and frame 12 may be equipped with corresponding magnet sensing switches. The magnets and magnet sensing switches prevent operation of the compactor when container 22 is misaligned or when door 20 is open.

A compaction ram 50 extends downwardly from the top of the frame. A hydraulic pump (not shown) and motor 54 control movement of ram 50. Compaction ram 50 is driven down into container 22 to compact the refuse received from chute 30. The compaction ram can exert a force in excess of three thousand pounds on refuse in container 22.

The distance between lip 32 of safety chute 30 and compaction ram 50 is an important safety consideration due to the force exerted by the ram. The distance between chute lip 32 and compaction ram 50 should be great enough to make it difficult for a user of the refuse compactor to place his hand underneath the lower end of the compaction ram when the ram is in a raised position. Preferably, the distance between chute lip 32 and compaction ram 50 is approximately twenty-nine inches.

The height of chute lip 32 is also a safety consideration. The chute lip should be high enough so that an adult would have to deliberately bend down and over lip 32 to reach compaction ram 50, and a small child would find it an effective barrier to reaching the compaction ram. Preferably, the height of chute lip 32 is approximately forty inches.

A cross-member 52 is located in the upper closed portion 14 of frame 12. Cross-member 52 supports the hydraulic pump and motor 54 and is connected to the subframe 60.

When compaction ram 50 is lowered for compacting refuse, the ram fits easily inside container 22. Because an individual's hand can fit without injury into the space between the compaction ram and a side wall of container 22, a safety switch is provided to reduce the chance of injuries.

Figure 2:
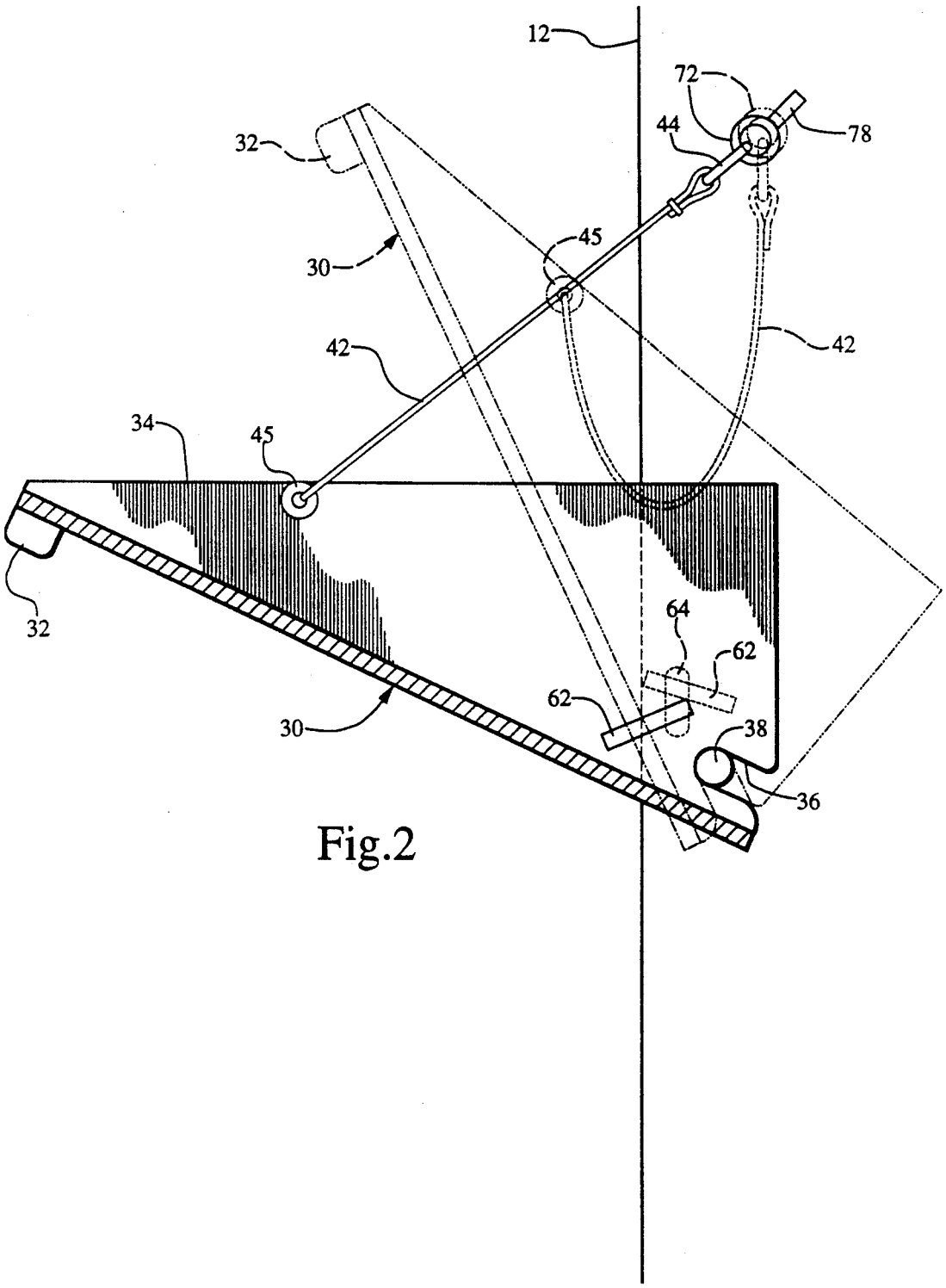
FIG. 2 is an enlarged side view of the safety chute of the refuse compactor illustrated in FIG. 1, illustrating the safety switch.

Referring now to FIG. 2, there is shown an enlarged side view of a safety chute 30 of the compactor illustrated in FIG. 1, illustrating a safety switch to prevent operation of the compactor when the safety chute is misaligned or absent from the compactor.

Notches 36 in side wall 34 of safety chute 30 slidably engage pivots 38 mounted in frame 12 to anchor the safety chute to the frame. A lip 32 on the front side of chute 30 prevents access to the compaction ram (not shown).

Cables 42 with snap links 44 at one end are connected to safety chute 30 and frame 12. Each cable 42 is placed through a hole 45 in the side wall of safety chute 30. A snap link 44 on one end of cable 42 attaches to eye ring 72 of the ring bolt. A cylindrical collar 78 prevents movement of eye ring 72 into frame 12.

The safety switch has two components. A bar magnet 62 is mounted on chute 30. Preferably, magnet 62 is positioned on one of the side walls of chute 30. A magnet sensing switch 64, such as a magnet sensing reed switch, is mounted on frame 12.

The magnet sensing switch is wired in series into the control circuit (FIG. 6) of the compactor. Reed switch 64 is a glass capsule containing two thin metal blades or reeds which overlap one another. When magnet 62 moves sufficiently close to reed switch 64, the magnetic field of magnet 62 magnetizes the metal reeds. The magnetized reeds touch, closing switch 64 and the control circuit. The compactor will not operate unless switch 64 and the control circuit are closed. The reed switch closes in response to the magnetic field of magnet 62. Magnets having different field strengths may be employed to obtain selected performance characteristics.

If safety chute 30 is absent from the compactor or misaligned on pivots 38, reed switch 64 remains open. This interruption of the control circuit prevents the compactor from operating if switched on.

Reed switch 64 is also wired in series with a safety switch (not shown) on the subframe of the compactor. When either switch is open, the refuse compactor will not operate.

Figure 3A:
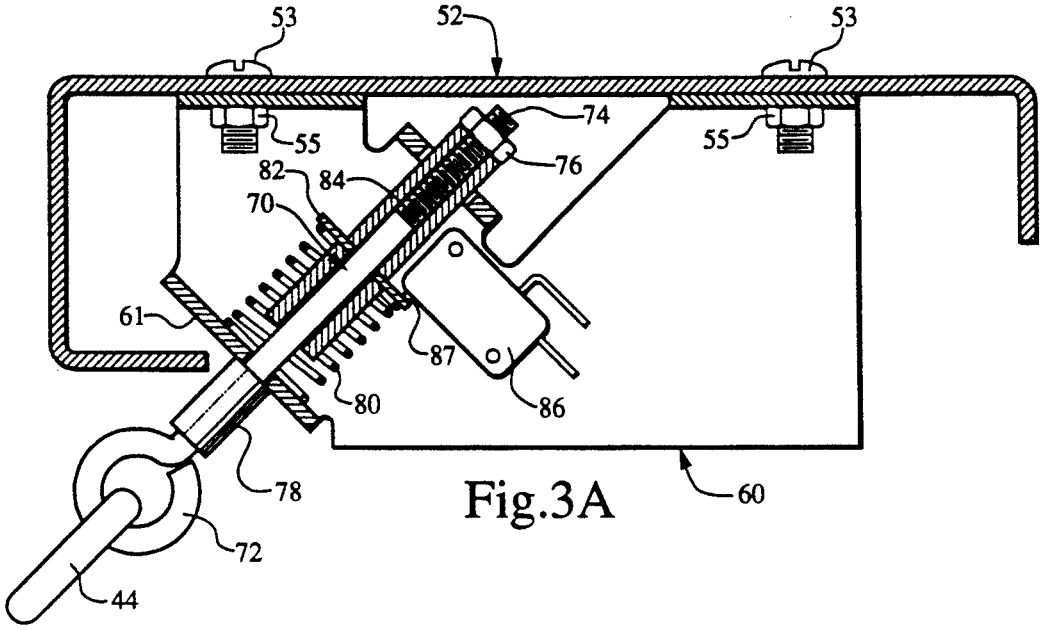
FIG. 3A is an enlarged cross-sectional view of the safety feature in the subframe component of the refuse compactor shown in FIG. 1, illustrating the spring in the normal or relaxed position.
Figure 3B:
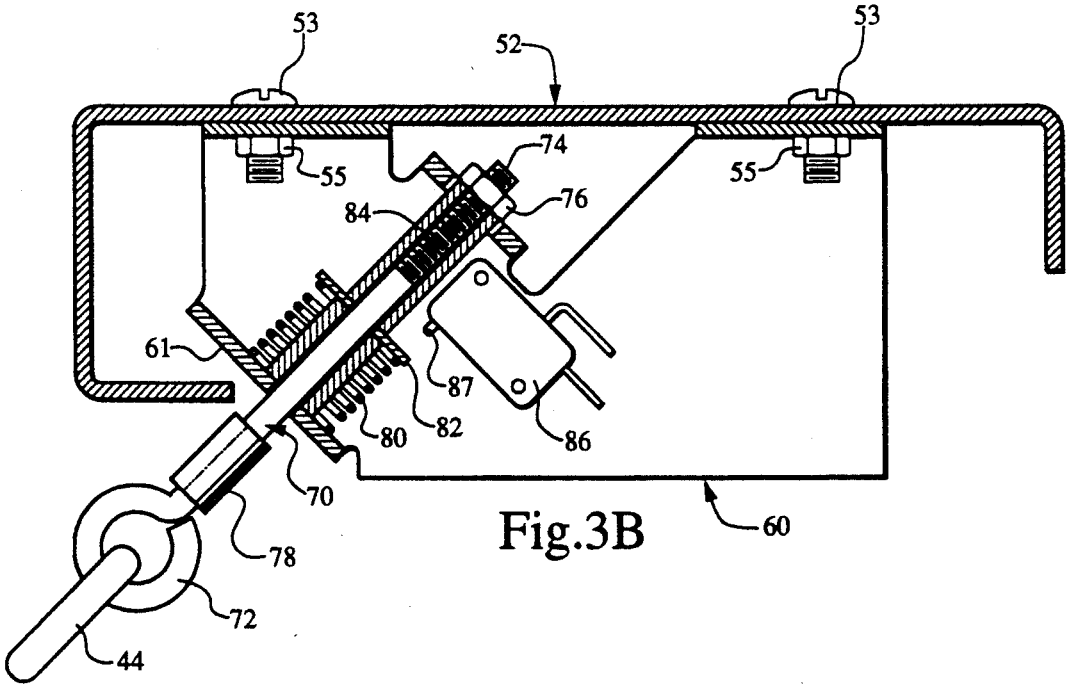
FIG. 3B is an enlarged cross-sectional view of the safety feature in the subframe component of the refuse compactor shown in FIG. 1, illustrating the deflection of the spring when a predetermined load is placed on the safety chute.

Because a child could use a chair to reach or climb into safety chute 30, the present invention includes additional safety features to address this potential problem. FIGS. 3A and 3B illustrate the refuse compactor's response when excess load is placed on the cable supporting the safety chute.

Referring now to FIG. 3A, there is shown an enlarged cross-sectional view of the subframe of the compactor. Subframe 60 is mounted, via nuts 55 and bolts 53 or some other attachment device, to cross-member 52 of the main compactor frame. The subframe includes at least one angled surface 61.

A ring bolt 70 is mounted to subframe 60. Ring bolt 70 is mounted to subframe 60 through a hole in angled surface 61. The ring bolt has an eye 72 and an opposite threaded end 74. Eye 72 of ring bolt 70 attaches to a snap link 44 securing a cable (not shown) to the safety chute (not shown). The threaded end 74 of ring bolt 70 threadably engages an adjusting nut 76 to adjustably maintain the position of the bolt inside subframe 60.

A cylindrical collar 78 is slidably disposed on bolt 70 between eye 72 and threaded end 74. Collar 78 and bolt eye 72 are disposed outside of subframe 60. Collar 78 is restrained by surface 61 to prevent movement of eye 72 into subframe 60.

Bolt 70 is axially disposed within a spring 80 inside subframe 60 between surface 61 and a washer 82. In FIG. 3A, spring 80 is shown in its relaxed position. Washer 82 is positioned on bolt 70. The threaded end 74 of bolt 70 is disposed in sleeve 84.

Spring 80 acts through washer 82, sleeve 84, and adjusting nut 76 to maintain bolt 70 in subframe 60. The spring should be strong enough to support the load of the safety chute and allow for the weight of refuse placed on the chute. Further, spring 80 should also be capable of sustaining additional loads, such as might be imposed by a small child capable of climbing into the chute.

A contact switch 86 is disposed near ring bolt 70. The contact switch is a conventional contact switch manufactured to have greater precision. Contact switch 86 is wired in series into the control circuit (FIG. 6) of the compactor. A plunger 87 is located on the side of contact switch 86 nearest to washer 82. Normally, plunger 87 on switch 86 touches washer 82, closing the switch. Contact switch 86 must be closed for the compactor to operate.

A person climbing on the safety chute or otherwise applying excessive load to the cables connecting the safety chute to the frame causes deflection of spring 80. Deflection of spring 80 causes washer 82 to move toward the spring. Depending on the calibration of contact switch 86, movement of washer 82 towards spring 80 breaks the contact between washer 82 and plunger 87. Contact switch 86 can be adjusted using threaded end 74 and adjusting nut 76 to vary the movement of washer 82 necessary to break contact with plunger 87. The switch can be calibrated to detect as little as 1/1000 inch movement of the washer away from the plunger. Thus, contact switch 86 can be adjusted to respond to a load placed on the chute by a child or an adult.

When washer 82 breaks contact with plunger 87, switch 86 opens. The compactor is immediately disabled by the interruption of the control circuit. A ring bolt/contact switch assembly is placed on two sides of the safety chute to detect movement from either direction.

Contact switch 86 is also wired in series with the magnetic sensing switch mounted on the frame. If either switch is open, the compactor will not operate.

Referring now to FIG. 3B, there is shown an enlarged cross-sectional view of subframe 60 of the compactor, illustrating the deflection of spring 80 when a predetermined load is applied to the cables or the safety chute.

The safety chute is attached to subframe 60 via a cable (not shown) and snap link 44 attached to eye ring 72. When a predetermined load is placed on the cables or the chute, spring 80 compresses against surface 61 of subframe 60. Washer 82 withdraws from contact switch 86, interrupting the contact between washer 82 and plunger 87. Contact switch 86 opens, and the compactor is disabled.

Figure 4:
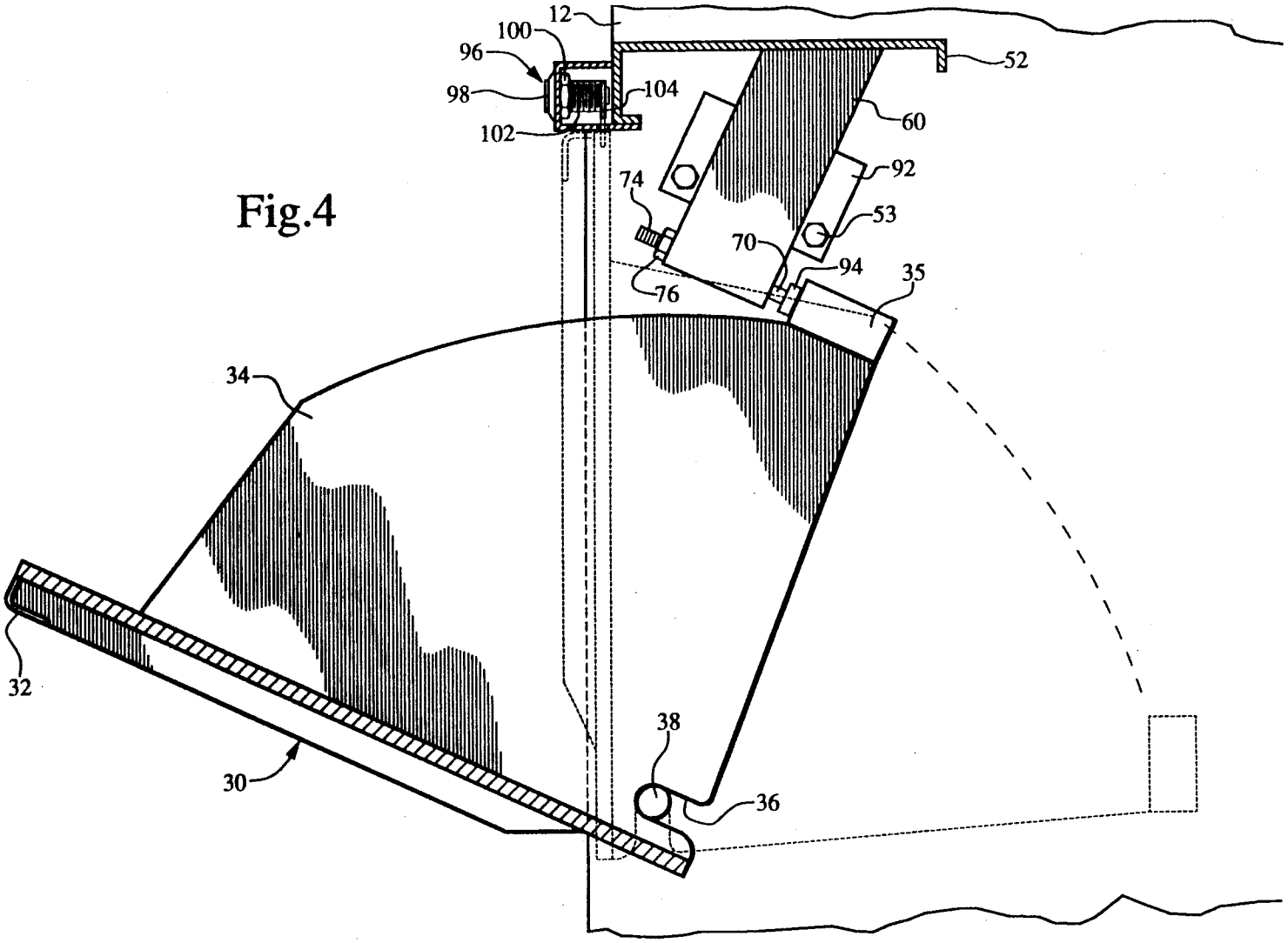
FIG. 4 is an enlarged side view of the safety chute of the refuse compactor according to a second embodiment of the present invention, illustrating an alternative safety feature.

Referring now to FIG. 4, there is shown an enlarged side view of the safety chute of the refuse compactor, illustrating a second embodiment of the invention incorporating another safety feature. In this alternative embodiment, the safety chute may be closed and locked when the refuse compactor is not operating.

Notches 36 in side wall 34 of safety chute 30 slidably engage pivots 38 mounted in frame 12 to anchor chute 30 to frame 12. Lip 32 on the front side of chute 30 prevents access to the compaction ram (not shown).

A bumper member 35 is disposed along the upper edge of side wall 34. When safety chute 30 is raised to a vertical position, the weight of bumper member 35 and the force of gravity hold the chute in an upright position. Chute 30 may be locked in a vertical position if desired.

Cross-member 52 is secured to the main compactor frame 12. Subframe 60 with plate 92 attaches to and extends downwardly from cross-member 52. Nuts (not shown) and bolts 53 in plate 92 secure subframe 60 to frame 12.

A bolt 70 and spring (not shown) are disposed inside subframe 60. The threaded end 74 of bolt 70 threadably engages nut 76 to adjustably maintain the position of the bolt inside subframe 60.

A bumper stop 94 is mounted to the head of bolt 70. When chute 30 is in an open, unlocked position, bumper member 35 abuts bumper stop 94. Pressure exerted by bumper member 35 against bumper stop 94 prevents chute 30 from pivoting beyond a predetermined position. The bumper member and bumper stop replace the cable and snap link assembly illustrated in the first embodiment.

A key-lock assembly 96 is mounted on a side wall of frame 12. Preferably, key-lock assembly 96 is a conventional lock of the type used in office furniture or desks.

A key (not shown) may be inserted into opening 98 of lock assembly 96. A tumbler 102, located inside lock assembly 96, is activated by insertion of the proper key into opening 98. Nut 100 anchors tumbler 102 inside lock assembly 96.

A latch 104, connected to tumbler 102, may be reciprocatingly advanced into and withdrawn out of a slot formed in the upper end of the safety chute. When safety chute 30 is in its upright or closed position, latch 104 can be advanced into the slot in chute 30, restraining pivotal movement of chute 30. When key-lock assembly 96 is unlocked, latch 104 can be withdrawn from the slot so as not to engage chute 30, permitting chute 30 to freely pivot between open and closed positions.

Figure 5A:
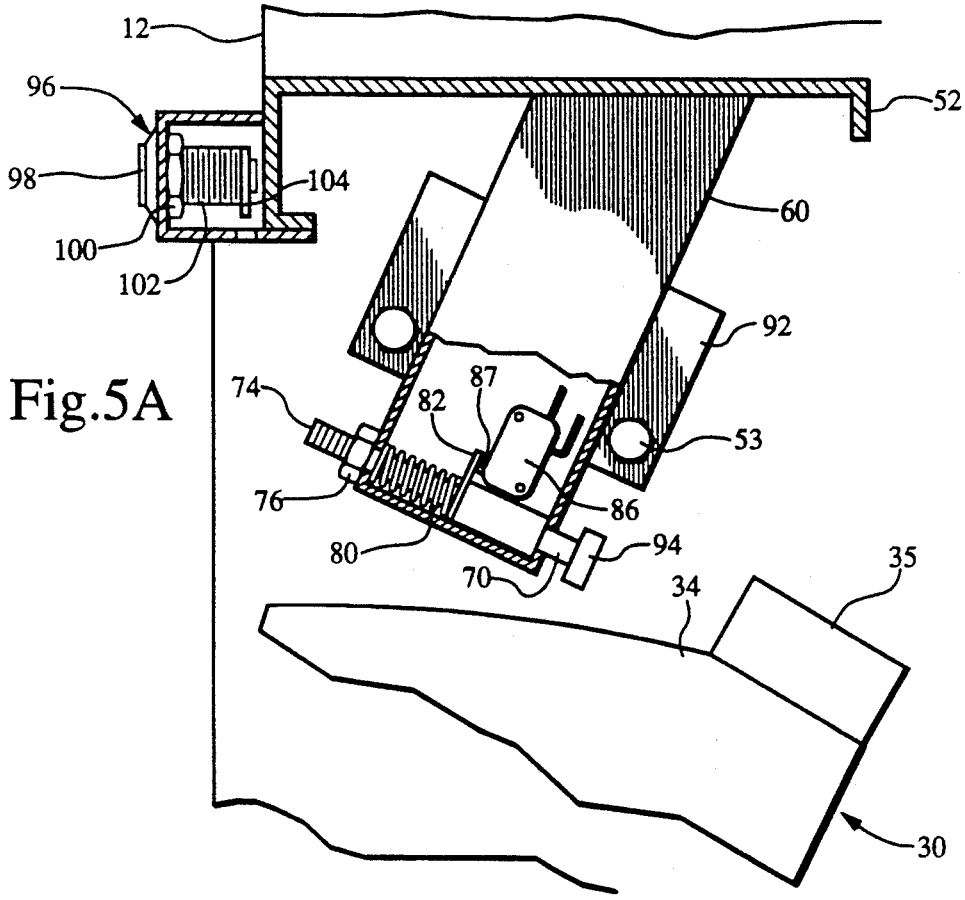
FIG. 5A is a cross-sectional view of the key-lock and subframe components of the refuse compactor according to a second embodiment of the present invention, illustrating the spring in the normal or relaxed position.

Referring to FIG. 5A, there is shown a cross-sectional view of the key-lock assembly and subframe components of the refuse compactor of the second embodiment, illustrating the spring in its relaxed state.

Key-lock assembly 96 is mounted on the exterior of frame 12. A key (not shown) may be inserted into opening 98 to activate tumbler 102, causing latch 104 to advance into a slot (not shown) formed in chute 30. Nut 100 mounts tumbler 102 inside lock assembly 96.

Subframe 60 is mounted, via plate 92, nuts (not shown) and bolts 53 or some other attachment device, to cross-member 52 and to frame 12. A bolt 70 is slidably mounted into subframe 60 through a hole in the subframe. Bolt 70 has a threaded end 74 and an opposing head. The threaded end 74 of bolt 70 threadably engages adjusting nut 76 to adjustably maintain the position of bolt 70 inside subframe 60.

A bumper stop 94 is mounted to the head of bolt 70 extending outside of subframe 60. Bumper stop 94 abuts bumper member 35 on side wall 34 of chute 30 to prevent the safety chute from pivoting beyond a predetermined position.

Bolt 70 is axially disposed within a spring 80 and through a washer 82. FIG. 5A shows spring 80 in a relaxed condition. The spring force, acting against washer 82 and adjusting nut 76, maintains bolt 70 in subframe 60. The spring should have sufficient spring force to support the load of the safety chute, as well as allow for the additional weight of refuse placed on the chute. Further, the spring should flex under the weight of a small child capable of climbing into the safety chute.

A contact switch 86 is disposed near bolt 70. Contact switch 86 is a conventional contact switch manufactured to have greater precision. Contact switch 86 is wired in series into the control circuit (FIG. 6) of the refuse compactor. A plunger 87 is positioned on the side of contact switch 86 nearest to washer 82. Washer 82 is positioned on bolt 70. Normally, plunger 87 on switch 86 touches washer 82, closing the switch. Contact switch 86 must be closed for the compactor to operate.

A person climbing on the safety chute or otherwise applying excessive load to the bumper stop causes deflection of spring 80. Deflection of spring 80 causes washer 82 to move toward the spring. Depending on how switch 86 is calibrated, movement of washer 82 towards spring 80 breaks the contact between washer 82 and plunger 87. Contact switch 86 can be adjusted, using threaded end 74 and adjusting nut 76, to vary the movement of washer 82 necessary to break contact with plunger 87. When washer 82 breaks contact with plunger 87, contact switch 86 opens. The compactor is immediately disabled as the control circuit is interrupted.

Figure 5B:
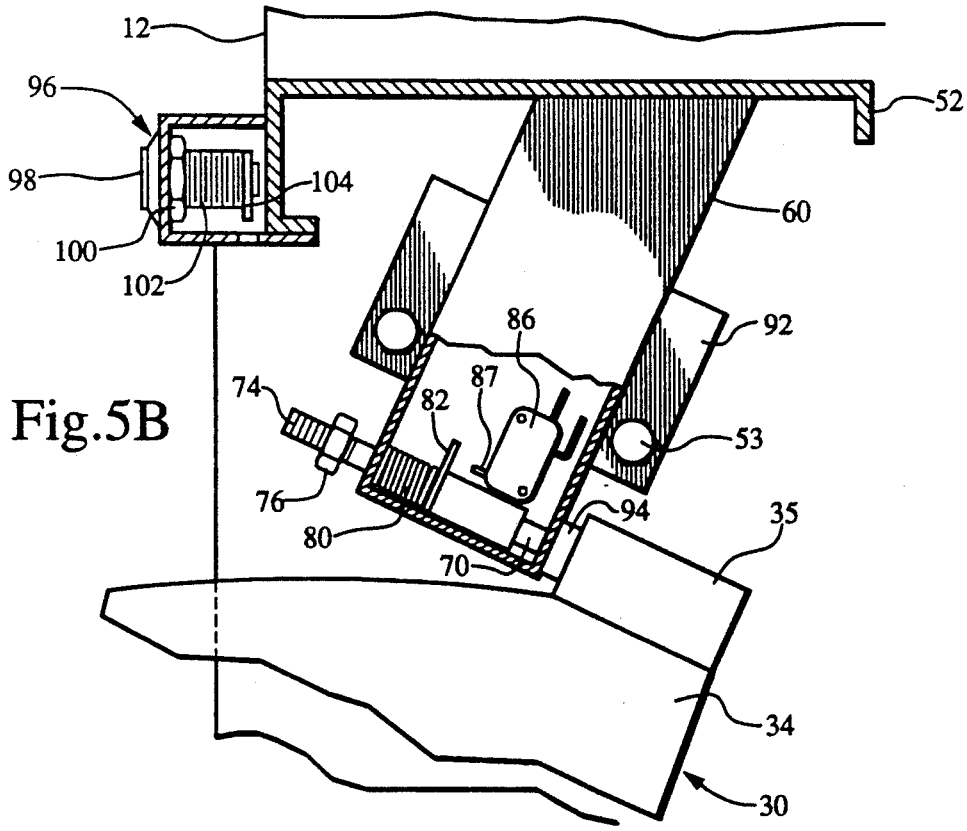
FIG. 5B is a cross-sectional view of the key-lock and subframe components of the refuse compactor according to a second embodiment of the present invention, illustrating the deflection of the spring when a predetermined load is placed on the safety chute.

FIG. 5B is a cross-sectional view of the key-lock assembly and subframe components of the refuse compactor of the second embodiment, illustrating the deflection of the spring when a predetermined load is placed on the safety chute or bumper stop.

Bumper member 35 on safety chute 30 abuts bumper stop 94 mounted on bolt 70. When a predetermined load is applied to chute 30 or bumper stop 94, the bumper stop moves toward subframe 60, repositioning bolt 70 in subframe 60.

Movement of bumper stop 94 toward subframe 60 causes spring 80 inside subframe 60 to compress. Washer 82 is withdrawn from contact switch 86, interrupting the contact between washer 82 and plunger 87, opening switch 86 and immediately disabling the refuse compactor.

Figure 6:
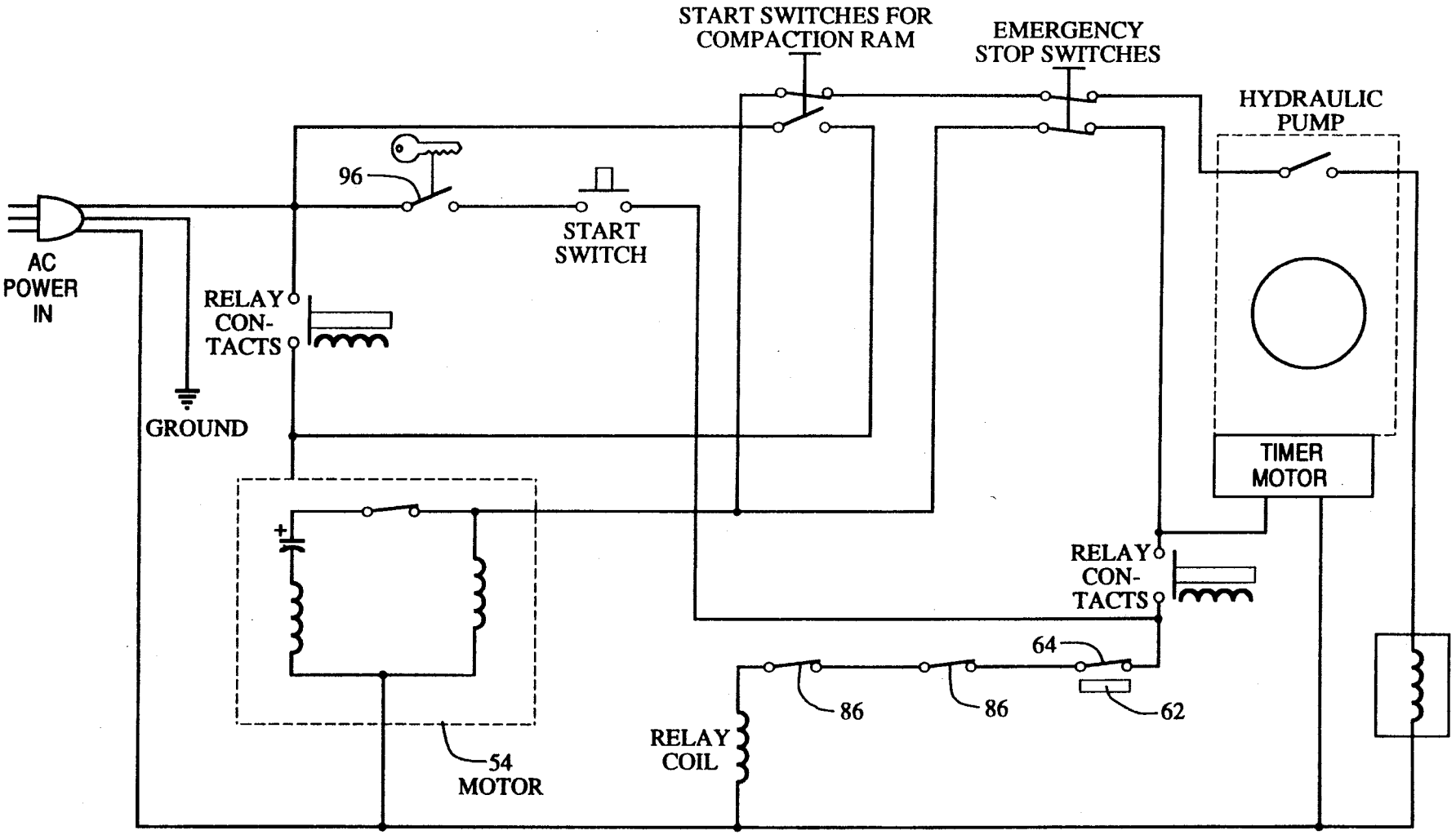
FIG. 6 is a schematic diagram of the electrical circuit of the refuse compactor of the present invention.

FIG. 6 is a schematic diagram of the electrical circuit of the refuse compactor of the present invention. Contact switch 86 and the magnet sensing switch 64 are wired into the hydraulic pump and motor 54.

Although preferred and alternative embodiments of the present invention have been illustrated in the accompanying Drawings and described in the foregoing Detailed Description, it will be understood that the invention is not limited to the embodiments disclosed, but is capable of numerous rearrangement, modifications, and substitutions of parts and elements without departing from the spirit of the invention.

I claim:

1. A waste disposal system connected to a power source for receiving and compacting refuse deposited by a user, comprising:

a frame having an open and a closed portion;

a container disposed in the frame dimensioned to receive waste from a chute;

a first chute having side and rear walls, pivotally mounted to the frame capable of receiving waste to be compacted and discharging it into the container;

a compaction ram mounted in the frame capable of compacting waste received by the container;

means connected to the power source for driving the compaction ram; and control means connected to the driving means and the power source, the control means capable of interrupting the power source in response to attempted intrusion by the user into a hazardous area in the open portion of the frame, the control means including means for detecting a load on the chute in excess of a predetermined amount thereby causing the control means to interrupt the power source.

2. A waste disposal system, as recited in claim 1, further comprising a second chute pivotally mounted on the frame opposite the first chute.

3. A waste disposal system, as recited in claim 1, wherein said detection means includes a load sensing means and a contact switch mounted to the frame, the contact switch capable of maintaining a connection between the power source and the driving means when the load sensing means is in mechanical contact with the switch.

4. A waste disposal system, as recited in claim 3, wherein said load sensing means includes a bolt slidably disposed within the frame, the bolt having an eye disposed at one end, a threaded surface at the opposite end thereof, and a washer slidably disposed on the bolt intermediate of the eye and the threaded surface of the bolt;

the bolt having a spring circumferentially disposed along the axis thereof between the eye and the washer, the spring capable of biasing the washer into mechanical contact with the contact switch when an axial load less than a predetermined amount is applied to the bolt.

5. A waste disposal system, as recited in claim 4, further comprising a nut threadably engaging the threaded surface of the bolt for adjusting the tension in the spring.

6. A waste disposal system, as recited in claim 3, further comprising a cable connected at one end to the eye of the bolt and at the other end to the chute, the cable adapted to transfer a load placed on the chute to the bolt.

7. A waste disposal system, as recited in claim 3, wherein said load sensing means includes a bolt slidably disposed with the frame, the bolt having a bumper member disposed at one end, a threaded surface at the opposite end thereof, and a washer slidably disposed on the bolt intermediate of the bumper member and the threaded surface of the bolt;

the bolt having a spring circumferentially disposed along the axis thereof between the washer and the threaded surface of the bolt, the spring capable of biasing the washer into mechanical contact with the contact switch when an axial load less than a predetermined amount is applied to the bolt.

8. A waste disposal system, as recited in claim 7, further comprising bumper means connected to the chute, adapted to abut the bumper member on the bolt to interrupt mechanical contact between the washer and the contact switch when a predetermined load is applied to the chute.

9. A waste disposal system, as recited in claim 1, further comprising a nut threadably engaging the threaded surface of the bolt for adjusting the tension in the spring.

10. A waste disposal system, as recited in claim 1, further comprising locking means for locking the first chute to the frame.

11. A waste disposal system, as recited in claim 10, wherein the first chute defines a slot capable of engaging the locking means when the first chute is in a closed position.

12. A waste disposal system, as recited in claim 11, wherein the locking means includes a tumbler responsive to a key inserted into an opening in the locking means; a latch rigidly connected to the tumbler capable of being reciprocatingly advanced into the slot in the first chute when the first chute is in a closed position to restrain pivotal movement of the chute.

13. A waste disposal system, as recited in claim 1, further comprising means for detachably mounting the first chute to the frame.

14. A waste disposal system, as recited in claim 13, wherein the means for detachably mounting the first chute to the frame includes a notch in the side wall of the first chute and a pivot mounted on the frame.

15. A waste disposal system connected to a power source for receiving and compacting refuse deposited by a user, comprising:

a frame;

a container disposed in the frame dimensioned to receive waste from a chute;

a compaction ram mounted in the frame capable of compacting waste received by the container;

means connected to the power source for driving the compaction ram;

a cross-member mounted to the frame capable of supporting the driving means;

a subframe mounted to the cross-member;

a first chute pivotally mounted to the frame capable of pivoting between open and closed positions, the chute including:

a housing capable of receiving waste deposited by users;

a lip formed on the front edge of the housing to prevent access by users to the compaction ram; and a magnet mounted on a side wall of the housing;

a reed switch mounted on the frame and disposed proximate the magnet, adapted to open and close in response to changes in the magnetic field caused by misalignment or absence of the first chute;

a bolt slidably mounted within the subframe, the bolt having an eye disposed at one end and a threaded surface at the opposite end thereof;

a sleeve enclosing the threaded surface of the bolt;

a support cable connected at one end to the bolt and at the other end to the first chute, adapted to transfer a load placed on the first chute to the bolt;

a snap link detachably mounted to the bolt capable of attaching the cable to the frame;

a washer slidably disposed on the bolt intermediate of the bolt eye and the threaded surface of the bolt;

a contact switch mounted to the subframe proximate the washer, the switch capable of maintaining a connection between the power source and the driving means when the washer is in mechanical contact with the switch;

a spring circumferentially disposed along the bolt between the bolt eye and the washer, capable of biasing the washer into mechanical contact with the switch when an axial load less than a predetermined amount is applied to the bolt;

a nut threadably engaging the threaded surface of the bolt for adjusting the tension in the spring; and a cylindrical collar axially disposed on the bolt between the bolt eye and the threaded surface of the bolt, adapted to restrain movement of the bolt eye toward the spring.

* * * * *